United States Patent [19]

Norris

[11] 4,061,473

[45] Dec. 6, 1977

[54] PROCESS TO EMBODY WASTE AUTOMOTIVE LUBRICATING OILS INTO A FUEL ADDITIVE TO REDUCE CORROSION AND DEPOSITS AND AUGMENT ENERGY AVAILABILITY

[76] Inventor: Robert S. Norris, 72 Pondfield Road West, Apt. 1-F, Bronxville, N.Y. 10708

[21] Appl. No.: 606,710

[22] Filed: Aug. 21, 1975

[51] Int. Cl.[2] ..... C10L 1/32

[52] U.S. Cl. ..... 44/51; 44/67; 44/DIG. 3

[58] Field of Search ..... 44/51, 68, DIG. 3; 208/179; 252/18, 33.3; 110/7 B

[56] References Cited

U.S. PATENT DOCUMENTS

| | | | |
|---|---|---|---|
| 2,671,758 | 3/1954 | Vinograd et al. | 44/51 |
| 3,002,825 | 10/1961 | Norris | 44/51 |
| 3,002,826 | 10/1961 | Norris | 44/51 |
| 3,036,901 | 5/1962 | Sanders, Jr. et al. | 44/51 |
| 3,346,483 | 10/1967 | Somogyi et al. | 208/179 |
| 3,565,021 | 2/1971 | Hill | 110/7 B |
| 3,958,518 | 5/1976 | Yoshida | 110/7 B |

FOREIGN PATENT DOCUMENTS

| | | | |
|---|---|---|---|
| 689,579 | 4/1953 | United Kingdom | 44/DIG. 3 |

OTHER PUBLICATIONS

"Investigating Waste Oil Disposal by Combustion", vol. 81, 1974, G. De Bono, p. 303, 96085c.

"Waste Lubricating Oil Research: Several Rerefining Methods", vol. 81, 1974; Whisman et al., p. 272, 140607a.

"Waste Automotive Lubricating Oil Reuse as a Fuel", U.S. Environmental Protection Agency, EPA-600-/5-74-032, Sept. 1974, pp. 15, 48, 50, 51.

*Primary Examiner*—Daniel E. Wyman
*Assistant Examiner*—Mrs. Y. Harris-Smith

[57] ABSTRACT

A process which makes use of waste automotive lubricating oils as an energy source, and function as an emulsifier, into which oils are embodied, and agitated, aqueous solutions of water-soluble salts of those metals which inhibit corrosion and minimize deposits when fuel oils are burned. The resultant fuel oil additive, as a water-in-oil emulsion, is introduced into fuels which contain corrosives, prior to combustion in boilers, gas turbines, or diesel engines. Upon combustion, the inhibiting metals from the additive combine with the corrosives in the fuel to form innocuous compounds.

16 Claims, No Drawings

PROCESS TO EMBODY WASTE AUTOMOTIVE LUBRICATING OILS INTO A FUEL ADDITIVE TO REDUCE CORROSION AND DEPOSITS AND AUGMENT ENERGY AVAILABILITY

This invention relates to fuel oil additives and a process to augment energy availability from the heat of burning waste oils as fuels. Applicant claims ownership of U.S. Pat. Nos. 3,002,825 and 3,002,826, both issued Oct. 3, 1961, and to ownership of U.S. Pat. No. 3,334,976 issued Aug. 8, 1967.

In a report by the Office of Research and Development, U.S. Environmental Protection Agency, titled "Waste Automotive Lubricating Oil Reuse As A Fuel", (EPA-600/5-74-032, September, 1974), it is stated that such waste oil as fuels might represent a little less than 0.5% of the total fossil fuel production in the United States. It is further stated that the quantity of such waste oils is estimated to be as much as 700,000,000 gallons annually in the U.S.A., and continues to increase.

As the owner of the aforementioned U.S. Patents, Applicant has produced commercially thousands of gallons of fuel oil additives in accordance with the claims of the aforesaid U.S. Patents, and has many case histories to substantiate the fact that the additives so produced do indeed render innocuous to the parts of a combustion chamber, those fuel oils which contain the corrosive elements of vanadium, sodium, and sulfur. These case histories include applications of the additives to fuels containing these corrosives which are burned in diesel engines, gas turbines, and boilers.

Having read and studied the Report by the U.S. Environmental Protection Agency, as well as a Publication by the U.S. Federal Energy Administration, titled "Waste Oil Fact Sheet", it occurred to Applicant that some better use could be made of these waste lubricating oils, which when new contained some of the same expensive chemicals as those which are embodied into the fuel oil additives manufactured under the claims of the abovementioned U.S. Patents. For example, new high-quality automotive and diesel crankcase oils are frequently sold at the automotive service station for $1.25 per quart, and may be drained after a period of use, and then sold to a collector of waste oils at a price of one cent per gallon. Perhaps some eight percent of this waste oil may be recycled by the re-refiners to again be marketed as automotive crankcase oil, but the harmful fact is that much of the waste oil is exposed to the environment in the form of road oils, for dust control, or dumping into sewers, on to dumps, or into waterways.

For those skilled in the art of blending and compounding automotive and diesel engine crankcase lubricating oils, it is known that such oils, in order to qualify under U.S. Military Specification 2104-C, or those oils of a Series III Classification, as well as those with A.P.I. Designation SE-CB and SE-CC, must embody a petroleum sulfonate into the motor oil in sufficient quantity to attain an alkalinity factor, known as Total Base Number (TBN), on the order of 9 to 10. It is this same petroleum sulfonate content which imparts to the motor oil, its so-called "heavy-duty, detergent" properties. There are, of course, a number of other addition agents blended in to the new oil for such purposes as stabilizing agents, viscosity index improvers, anti-wear agents, and the like, but these are in relatively low percentages, as compared to the percentage of petroleum sulfonate blended in to the new oil. Some of these addition agents are organic compounds, and others might contain metalloorganics which are ash-forming upon combustion, but it is not anticipated that any of these metals would be harmful at the parts per million level resultant from the contemplated ratio of injection of additive into the heavy fuel oils. In fact, a metal such as zinc, which might have originated in the new motor oil as zinc di-thiophosphate anti-wear agent, could be beneficial toward the formation of a Zinc Vanadate to minimize corrosion by scaling. (See British Pat. No. 689,579).

It is accordingly a principal object of the present invention to provide a fuel oil additive which, when introduced into the fuel oil, will limit the corrosive effects and the troublesome deposits, attributed to the vanadium, sodium, and sulfur compounds present in residual type fuel oils, and which are also present to a lesser extent in distillate type fuels. In this objective function, by inhibiting the vanadium catalytic effect, a lesser amount of sulfur tri-oxide remains in the exit gases, and there is a resultant reduction in acid-smut soot emissions.

It is almost equally an important object of the present invention to beneficiate and make better use of the many millions of gallons of waste automotive and diesel engine crankcase oils, so that such oils can be burned in boilers, diesel engines, and gas turbines, to produce heat and energy at a time when fossil fuels are in short supply and extremely dear in cost.

It is still another important object of this invention to provide an incentive for the more effective collection and ultimate usage and application of these waste automotive lubricating oils. Each and every gallon of this waste oil which can be chanelled toward its utilization as fuel to produce heat or energy, is one gallon which will not end up as a contaminant to the environment. As a fuel treatment agent, the benefits resulting from this invention will out-weigh and overcome the prejudices or objections to the burning of waste automotive lubricating oils in boilers, diesel engines, or gas turbines.

Generally the present invention involves converting waste automotive crankcase lubricating oils into a fuel oil additive to reduce corrosion and deposits, and augment energy availability therefrom, wherein an improvement is derived by the preparation of an aqueous solution of a water-soluble salt selected from the group consisting of aluminum, barium, boron, calcium, chromium, copper, magnesium, manganese, samarium, silicon, tin and zinc, which aqueous solution is added to, agitated with, and emulsified into the waste crankcase lubricating oil in ratios which may vary from equal parts of the water phase and oil phase, to one part water phase into three parts oil phase.

EXAMPLE I

Applicant has discovered that a comparable additive to those produced by the processes of U.S. Pat. Nos. 3,002,825 and No. 3,002,826, can be produced by substituting a new premium grade motor oil of S.A.E. No. 10 through No. 50 viscosity, as the sulfonate emulsifier-plus-oil constituent as claimed in the aforesaid Patents, and into this motor oil as the emulsifier, is introduced and agitated an equal volume of a saturated aqueous solution of magnesium sulfate (Epsom Salts, technical grade - at approximately four pounds of which is dissolved in each gallon of water), and that a stable water-in-oil, creamy white colored, emulsion will result.

This water-in-oil emulsion additive contains approximately 20,000 parts per million of magnesium. Such an additive produced by this invention may be introduced into a #6 residual fuel oil which might contain 20 parts per million of vanadium, and if the additive dosage to such a fuel oil is maintained at a ratio of one part by volume of the additive to 1000 parts by volume of such a fuel oil, it will impart a treatment ratio of 1:1 as a Mg/V (magnesium to vanadium) ratio. Obviously, higher dosage rates would be required to maintain such a Mg/V ratio with higher vanadium content fuels.

The state of the art in times past, has advocated that a 3:1, magnesium to vanadium ratio should be maintained, but practical considerations have shown that such a high ash burden in the gas stream tends to block passages, particularly where high-vanadium content fuels are burned.

EXAMPLE II

In recognition of the fact that a certain amount of additive depletion occurs after usage as a motor oil in an automotive gasoline engine or diesel engine, Applicant has discovered that a similar additive to those produced as in Example I, can also be produced by the embodiment of used waste crankcase oil drainings, but that instead of blending equal volumes of the motor oil and aqueous Epsom Salts solution, it is adviseable to blend one part of the aqueous solution into three parts by volume of the used crankcase oil. This results in a stable water-in-oil emulsion which is black in color, due to the black color of the used crankcase oil, but color is of no importance if it is to be introduced into a black residual fuel oil. This additive, being diluted with more waste lubricating oil, now contains 10,000 parts per million of magnesium, and requires a dosage rate of two gallons of the additive be introduced into each 1000 gallons of the fuel oil which contains 20 parts per million of vanadium, in order to maintain the 1:1 ratio of Mg/V, as a corrosion inhibitor and to minimize fused deposits. In addition to the benefits which are derived as an inhibitor for the corrosives, and toward minimizing harmful deposits, each gallon of the additive, when burned, is providing approximately 110,000 B.T.U.s of additional heat value to the residual fuel oil.

As in Example I, if higher vanadium content fuels are being burned, a correspondingly higher dosage can be calculated to determine that dosage rate required to maintain a Mg/V ratio of 1:1. For example, a fuel oil containing 200 parts per million of vanadium, would require twenty gallons of additive to be introduced into each 1000 gallons of fuel oil, and this would be concurrently providing 1,100,000 B.T.U.s of additional heating value.

While this might seem to be a higher dosage rate than that recommended for some of the more conventional metal-containing additives, it should be pointed out that the cost of the additive by Applicants invention is only a small fraction of the cost of many of the more conventional additives. Also of importance, is the fact that this invention is making use of the waste oil toward producing heat and energy.

EXAMPLE III

In U.S. Pat. No. 3,581,491 (Bornstein and Decrescente), it is one object of that invention to provide means for preventing hot corrosion in gas turbine engines caused by sodium in the fuel or sodium, as sodium chloride, ingested in the air intake, by the addition of a chromium-containing additive to the fuel. Such a chromium-containing additive was produced by the process of this present invention by the preparation of an aqueous solution of magnesium chromate mixed at a concentration of one pound of magnesium chromate dissolved into one-gallon of water, and this magnesium chromate aqueous solution was then emulsified into three parts by volume of waste automotive lubricating oil. This additive contains both magnesium and chromium, and when present in a fuel oil, upon combustion, the magnesium chromate dissociates, leaving the magnesium available to combine with the vanadium in the fuel, to form a magnesium vanadate, and the chromium available to oxidize with the free oxygen to form a chromate which is innocuous.

Due to the contaminants present in waste crankcase lubricating oils, an additive produced by Example III might not be adviseable for application to those restrictive fuels recommended for aircraft-type gas turbines, which are also being installed in marine and industrial service. However, there are heavy-duty industrial gas turbines which can tolerate modified heavy distillate fuels or residual fuels, such as those classified as ASTM Designation No. 3-GT or ASTM Designation No. 4-GT.

EXAMPLE IV

It is mentioned in Example III that there are contaminants present in waste crankcase lubricating oils, and one of these contaminants might be lead which might originate from the leaded gasolines used in automotive gasoline engines. This objectionable contaminant is eliminated when a more selective accumulation of waste crankcase lubricating oil is collected from motor truck fleet operators, or from railroad locomotive maintenance shops, or from highway construction contractors, where almost all such equipment is diesel engine powered. There are no lead anti-knock compounds added to diesel fuels, and therefore there is no possibility for lead as a blow-by product of combustion which might contaminate this waste crankcase lubricating oil.

Usually, diesel engine crankcase lubricating oils are of the heavy-duty, detergent type, and therefore contain a high percentage of petroleum sulfonates. Therefore, an aqueous solution of either magnesium sulfate or magnesium chromate, or combinations of both, may be emulsified into a waste crankcase lubricating oil which has been used in diesel engine service, preferably added in the mixing ratios of one part by volume of the aqueous solution into three parts by volume of the waste crankcase oil. The resultant emulsion is applicable as a fuel oil additive for those boilers, gas turbines, or diesel engines burning low-grade fuels.

While the invention has been described with reference to particular examples and embodiments, it will be apparent to those skilled in the art, that various modifications may be made, and equivalents substituted therefor, without departing from the principles and true nature of the invention. Depending on the desired metallic or inorganic inhibitors which have been found to be beneficial, it is possible by means of this invention, to embody such beneficial metals or elements into the emulsion by the use of a multitude of water-soluble salts.

By way of further examples of this, Applicant has discovered that silicon may be introduced as one element in a fuel oil additive by preparing an aqueous solution of magnesium silico-fluoride and emulsifying this aqueous solution into a waste automotive crankcase oil, or into a petroleum sulfonate. Silicon is mentioned as beneficial, in the ASTM Specifications For Gas Turbine Fuel Oils. Other beneficial elements may be derived from the application of aqueous solutions of such water soluble salts as manganese sulfate, where manganese is desirable as a smoke suppressant (U.S. Pat. No. 2,818,417 — Brown, etal.), or from aluminum sulfate, where aluminum is desired for the purpose of producing more friable deposits on the heating surfaces or working parts.

Having thus set forth and disclosed the nature of my invention, what is claimed is:

1. A process of preparing a fuel oil additive comprising emulsifying a waste lubricating oil containing petroleum sulfonate detergent with an aqueous solution of a water soluble salt of an element selected from the group consisting of aluminum, barium, boron, calcium, chromium, copper, magnesium, manganese, samarium, silicon, tin and zinc.

2. The process of claim 1 wherein from equal parts of aqueous salt solution and waste lubricating oil to that of one part aqueous salt solution and three parts waste lubricating oil are emulsified.

3. The process of claim 2 wherein the aqueous salt solution is a solution of magnesium sulfate.

4. The process of claim 2 wherein the aqueous salt solution is a solution of magnesium silico-fluoride.

5. The process of claim 2 wherein the aqueous salt solution is a solution of magnesium chromate.

6. The process of claim 2 wherein the aqueous salt solution is a solution of manganese sulfate.

7. The process of claim 2 wherein the aqueous salt solution is a solution of samarium chloride.

8. The process of claim 2 wherein the aqueous salt solution is a solution of stannous chloride.

9. A fuel oil additive comprising an emulsion of an aqueous salt solution of a water soluble salt of an element selected from the group consisting of aluminum, barium, boron, calcium, chromium, copper, magnesium, manganese, samarium, silicon, tin and zinc in a waste lubricating oil containing petroleum sulfonate detergent.

10. The fuel oil additive of claim 9 wherein from equal parts of aqueous salt solution and waste lubricating oil to that of one part aqueous solution and three parts waste lubricating oil are emulsified.

11. The fuel oil additive of claim 10 wherein the aqueous salt solution is a solution of magnesium sulfate.

12. The fuel oil additive of claim 9 wherein the aqueous salt solution is a solution of magnesium silico-fluoride.

13. The fuel oil additive of claim 10 wherein the aqueous salt solution is a solution of magnesium chromate.

14. The fuel oil additive of claim 9 wherein the aqueous salt solution is a solution of manganese sulfate.

15. The fuel oil additive of claim 9 wherein the aqueous salt solution is a solution of samarium chloride.

16. The fuel oil additive of claim 9 wherein the aqueous salt solution is a solution of stannous chloride.

* * * * *